United States Patent [19]

Holm

[11] Patent Number: 4,562,886

[45] Date of Patent: Jan. 7, 1986

[54] TUBE CLEANER

[76] Inventor: Per T. Holm, Granvägen 5, Skoghall, Sweden, 663 00

[21] Appl. No.: 504,055

[22] PCT Filed: Sep. 30, 1982

[86] PCT No.: PCT/SE82/00307

§ 371 Date: Jun. 7, 1983

§ 102(e) Date: Jun. 7, 1983

[87] PCT Pub. No.: WO83/01296

PCT Pub. Date: Apr. 14, 1983

[30] Foreign Application Priority Data

Oct. 9, 1981 [SE] Sweden ..... 8105998

[51] Int. Cl.[4] ..... F28G 1/06; F28G 1/64; F28G 1/10

[52] U.S. Cl. ..... 165/94; 165/95; 122/379; 15/104.16; 15/104.19

[58] Field of Search ..... 165/94, 95; 122/379, 122/380; 62/354; 15/104.16, 104.19

[56] References Cited

U.S. PATENT DOCUMENTS

| | | | |
|---|---|---|---|
| 502,223 | 7/1893 | Burpee | 122/379 |
| 514,514 | 2/1894 | Stafford | 15/104.16 |
| 813,739 | 2/1906 | Ross | 15/104.19 |
| 1,007,423 | 10/1911 | Bernhardt | 122/379 |
| 1,448,048 | 3/1923 | Bahr | 165/95 |
| 1,611,820 | 12/1926 | Delo | 15/104.19 |
| 2,233,066 | 2/1941 | Watson | 165/95 |
| 2,628,380 | 2/1953 | Therrien | 15/104.19 |
| 3,460,180 | 8/1969 | Girard | 15/104.19 |

FOREIGN PATENT DOCUMENTS

| | | | |
|---|---|---|---|
| 0223307 | 9/1909 | Fed. Rep. of Germany | 15/104.16 |
| 0296717 | 3/1916 | Fed. Rep. of Germany | 122/379 |
| 478138 | 10/1927 | Fed. Rep. of Germany | 165/95 |
| 743580 | 12/1943 | Fed. Rep. of Germany | 15/104.16 |
| 2948387 | 6/1981 | Fed. Rep. of Germany | 165/94 |
| 103284 | 1/1917 | United Kingdom | 15/104.16 |
| 155871 | 1/1921 | United Kingdom | 15/104.16 |
| 2030672 | 4/1980 | United Kingdom | 165/95 |

*Primary Examiner*—Albert W. Davis, Jr.
*Assistant Examiner*—John K. Ford
*Attorney, Agent, or Firm*—Burns, Doane, Swecker & Mathis

[57] ABSTRACT

The invention is concerned with a device for the internal cleaning, under operation, of the tubes of a heat exchanger containing a plurality of substantially straight tubes (1*a*,1*b*,1*c*) having both ends fastened to tube sheets (2), head chambers outside the tube sheets for the medium flowing through the tubes, cleaning members (26,30) in the tubes, and driving means comprising cables (27,31) and cable drums (13,14) to propel the cleaning members forward and backward in the tubes. The cleaning device is characterized in that the cleaning member is a helical spring (26,30) and that the cables (27,31) are endless cables, or cables having a limited length, which extend over the cable drums (13,14) in the head chambers (11,12).

16 Claims, 15 Drawing Figures

TUBE CLEANER

FIELD OF THE INVENTION

The invention relates to a device for the internal cleaning, under operation, of the tubes of a heat exchanger containing a plurality of substantially straight tubes, a shell surrounding said tubes, and head chambers at the ends of the heat exchanger. The number of tubes may vary from a few to thousands of tubes. The heat exchanger is part of equipment, and it may be built into said equipment, or it may be combined with said equipment, or it may stand separate from said equipment. In the first two types of heat exchanger the shell or the head chambers may be parts of the equipment. The heat exchanger may be mounted in a horizontal or vertical position.

PRIOR ART

The nominal effect of a heat exchanger is based on the assumption that the heat transfer from the tube wall to the medium inside the tube, or the reverse, is not deteriorated by any coating which insulates and which reduces the flow velocity in the tube. Such a coating occurs, however, in most processes. It is very inconvenient, particularly in continuous processes, to have to reckon with a sinking effect of the heat exchangers. In addition, such a coating may stop the production, and may deteriorate the yield by changing the ratio of the desired to the undesired product. It may also increase the consumption of steam.

Such a coating on the tube wall may be of various types. In heat exchangers for a comparatively low temperature, for example in waterworks and sewage treating plants, the coating may consist of soft sludge. In heat exchangers for a comparatively high temperature, for example in chemical and petrochemical processing industries, the coating may consist of viscous tar, coke, and soot. In other heat exchangers, for example in the cellulose processing industry, the coating may form brittle deposits.

Few heat exchangers have means for the internal cleaning of the tubes under operation. The majority of heat exchangers are cleaned after having been taken apart during a stop of operation. Heat exchangers are often made oversize, to prolong the interval between cleaning operations. A cleaned heat exchanger is often kept in reserve, to minimize the time for the stop of operation. Such measures, however, necessitate an increased investment. Generally, the cost for cleaning the tubes and associated operations during the lifetime of a heat exchanger, say 5 years, correspond to 3 times the investment for the heat exchanger. To said cost must be added the costs for the interruptions of operation, the reduced production, and the lower yield, said additional costs being often considerable. The cleaning of the tubes after discontinuing the operation and taking the heat-exchanger apart is considered to be one of the dirtiest industrial jobs.

Several methods have been suggested for cleaning the tubes under operation. In one known method cleaning pistons are moved forward and backward through the tubes by means of rods, a common driving plate, and a pressurized cylinder. It is an inconvenience of said method that the loss of pressure is comparatively large, and that there is a risk of deposition on the cleaning pistons because they have a large surface in contact with the tube wall. It is another inconvenience that the device requires a large space, and that it can be used only for heat exchangers containing short tubes.

According to the Swedish Pat. No. 317,394 loose brushes are driven by the pumped medium forward and backward through the tubes. A catching basket for the brush is placed at each end of the tube. It is an inconvenience that the medium has to be pumped, that a system of valves and shunt conduits has to be arranged to reverse the flow of the medium, that a comparatively large loss of pressure is caused by the catching basket just outside the tube ends and by the brush inside said catching basket, that the mounting of the catching basket requires a deformation of the valuerable tube end, and that the plastic parts and the brush limit the use of the device to heat exchangers operating mainly with water and aqueous solutions having a comparatively low temperature and producing a deposit of soft sludge.

According to U.S. Pat. No. 1,795,348 cleaning balls are propelled continuously through the tube by the flowing medium. The balls are subsequently separated from the medium, and are returned to the inlet end of the heat exchanger by a pumped partial flow of the medium. It is an inconvenience that the cleaning is not very good on tough coatings, that balls stay in cavities in the apparatus, and that the balls are strongly abrasive on the pump and other parts of the apparatus which change the direction of the flow.

THE INVENTION

The invention aims at providing an improved cleaning device which results in a low flow resistance in the tubes, and which does not suffer from the inconveniences mentioned above. The invention is concerned with a cleaning device for the internal cleaning, under operation, of the tubes of a heat exchanger containing a plurality of substantially straight tubes having both ends fastened to tube sheets, head chambers outside the tubes for the medium flowing through the tubes, cleaning members in the tubes, and driving means comprising cables and cable drums to propel the cleaning members forward and backward in the tubes. The cleaning device is characterized in that the cleaning member is a helical spring, and that the cables are endless cables or cables of limited length which extend over the cable drums in the head chambers.

A cleaning spring may be fastened to two cables having well defined lengths, one cable being wound upon a cable drum in one of the head chambers while the other cable is being unwound from a cable drum in the other head chamber. It is an inconvenience that this device requires a large space, and that the tension in the cables will not be well defined. Therefore, we prefer to use endless cables. An endless cable, as referred to in the specification and claims, shall be interpreted to mean a cable plus one or two cleaning springs.

The cleaning spring is preferably a cylindrical helical spring having preferably $1\frac{1}{4}$–7 turns. In one or both ends the spring may be shaped like a conical spring. The outer diameter of the spring is preferably a little smaller than the inner diameter of the tube. A spring of this size can be brought into scraping contact with the tube wall by the cable being fastened to the spring in a more or less eccentric position, as will be disclosed below. Alternatively, the cleaning spring may have, in its unloaded condition, an outer diameter equal to the inner diameter of the tube, or even a bit larger. In this case it is necessary, during a running-in period, to apply an increased force of tension to the cable, in order to be able to pull the cleaning spring through the tube. The friction against the tube wall reduces the diameter of the spring. Therefore, after the running-in period only the normal force of tension is required.

DESCRIPTION OF A PREFERRED EMBODIMENT WITH REFERENCE TO THE DRAWINGS

Figure 1:
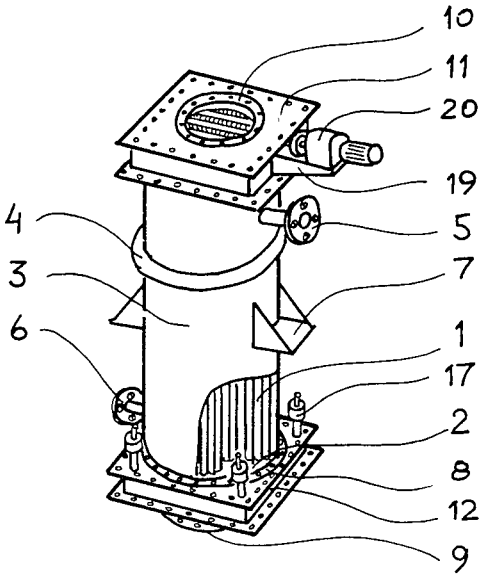
FIG. 1 is a perspective view of a heat exchanger of the type concerned, involving the invention.
Figure 2:
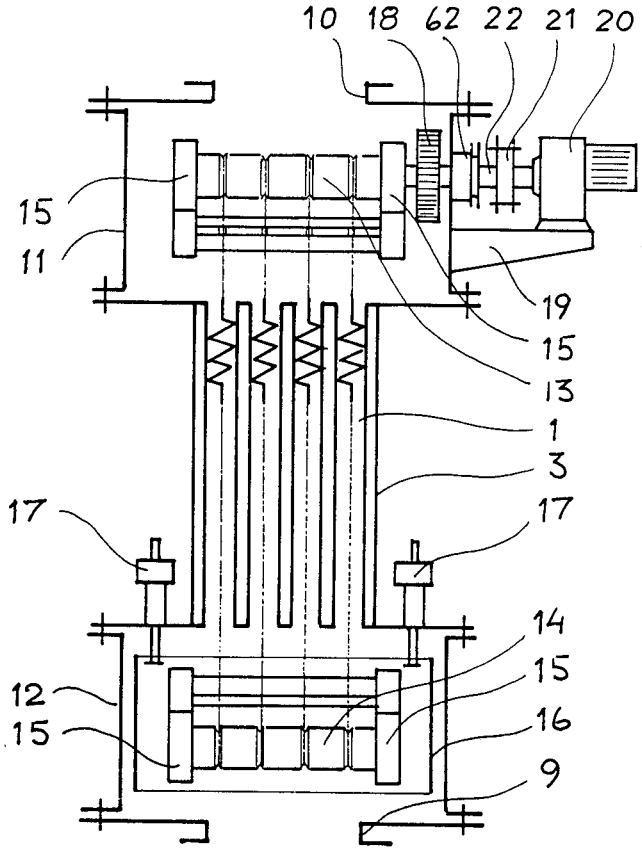
FIGS. 2 and 3 are cross-sections of, in principle, the heat exchanger of FIG. 1.
Figure 3:
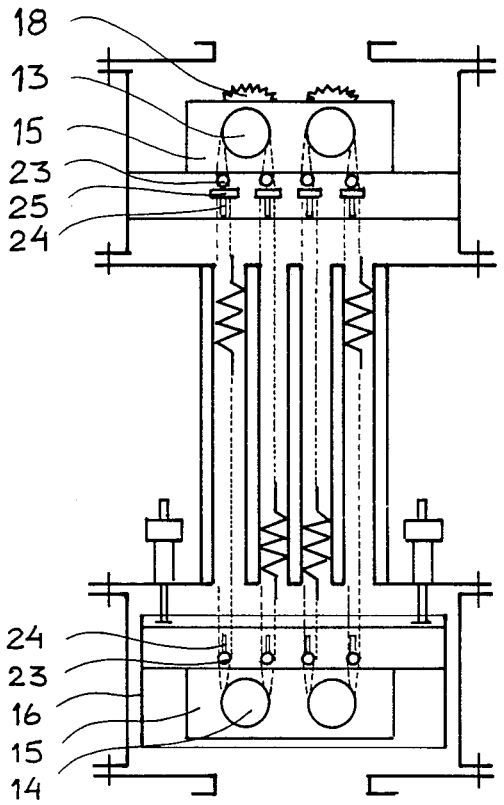

The heat exchanger contains a cluster of 355 tubes 1 having a total heat transferring surface of 54 $m^2$. The tubes are arranged in a standardized symmetric linear pattern, and are fastened at both ends to tube sheets 2 which are fastened to a shell 3. The shell is provided with an expansion bellows 4, an inlet 5 for steam, an outlet 6 for condensate, and two supports 7 for mounting the heat exchanger in upright position. At each tube sheet 2 there is usually arranged a conical chamber having a flange 8 facing the tube sheet 2 and flanges 9, 10 facing the equipment to which the heat exchanger belongs.

Figure 15:
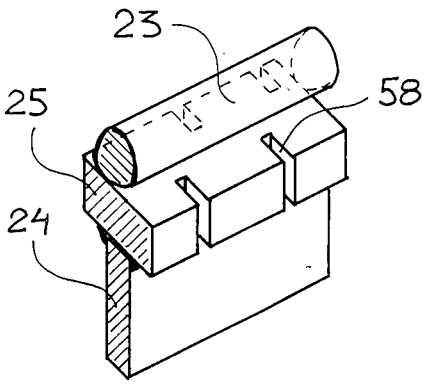
FIG. 15 is a perspective view of a section of a stop rod.

The head chambers consist of an upper housing 11 and a lower housing 12 for the cable drums. Each housing 11, 12 contains six cable drums 13, 14 having both ends mounted in bearings 15, The upper bearings are immovably mounted in the upper housing 11, whereas the lower bearings 15 are mounted in a movable frame 16. Said frame 16 is suspended from four tightening members 17 situated above the corners of the lower housing 12 and extending down into said housing 12. Each cable drum 13 in the upper housing 11 has its shaft extending through the bearing 15. A cog wheel 18 is mounted on said extended shaft, and said cog wheel engages a corresponding cog wheel 18 on the adjacent cable drum 13. A bracket 19, fastened to the upper housing 11, supports a motor 20 and a gear. The motor 20 is, via a coupling 21, a shaft 22, and a packing box 62, connected to the cog wheel 18 of one of the two middle cable drums 13. Each cable drum 13, 14 is, according to FIG. 4, designed to serve four rows of tubes 1, and cooperates with two cable guides 23 which are parallel with the cable drum 13, 14. The cable guides 23 consist of a rod having a circular cross section. Each cable guide is mounted on a support rod 24 which is fastened to the members carrying the bearings 15 in the upper housing 11 and in the frame 16 in the lower housing 12. The support rods 24 in the upper housing 11 are fastened to a T-shaped rod 24, 25, see FIG. 15, which is provided with open slots 58 at both edges. The number of slots 58 corresponds to the number of cables 27 on the cable drum 13, The slot 58 is wider than the diameter of the cable 27 but narrower than the diameter of the wire forming the cleaning spring 26.

The cable guides 23 consist of round rods of hardened steel. They are fastened by screws to supporting flat rods 24, 25. The diameter of the round rod corresponds to the distance between the cables 27, 28 of two adjacent rows of tubes 1. The thickness of the supporting rod 24 is smaller than the diameter of the round iron 23. The cable guide 23 directs the cable 27, 28 to go clear from the edge of the tube 1, so as to prevent the cable from wearing grooves into the edge of the tube. All cables 27, 28 between the cable drums 13, 14 and the tubes extend on the same side of the cable guide 23. Consequently, the length of contact between the cables 27, 28 and the V-shaped grooves 29 in the cable drum will be equal for all cables, and the pulling effect of the cable drum on the cables will be equal. The cable guides 23 can be omitted if the slots 58 have rounded bottom surfaces, so that the cables can slide on said surfaces without wear. In this case the rods 25 preferably consist of hardened steel.

Figure 4:
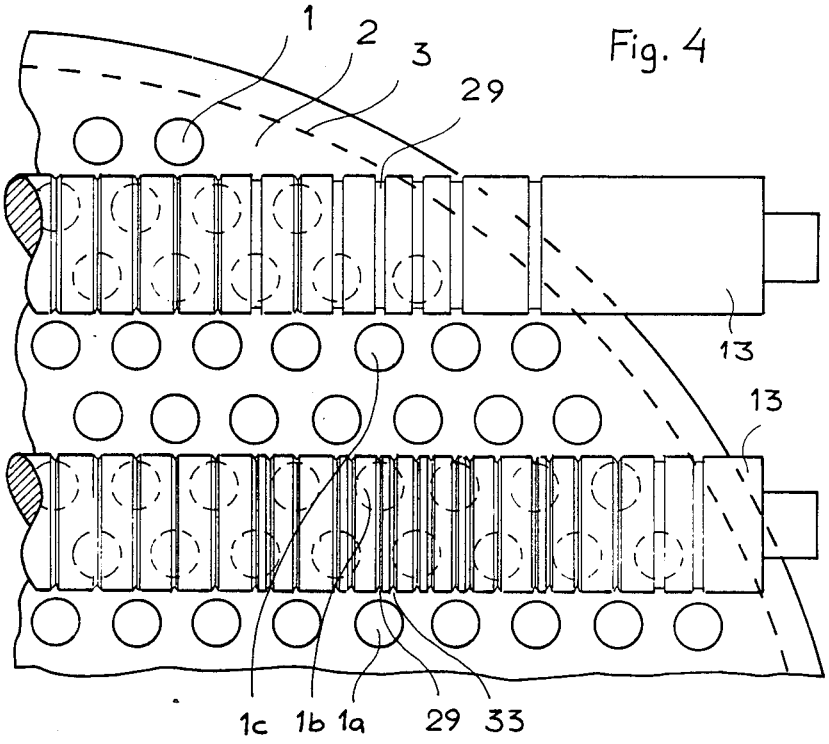
FIG. 4 is a top view of the heat exchanger illustrating the pattern of the tubes and the positions of the cable drums.
Figure 5:
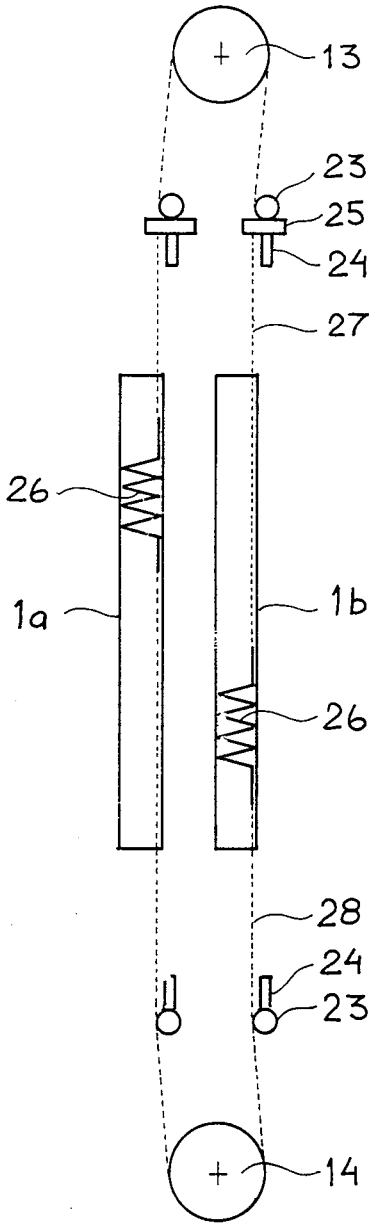
FIG. 5 illustrates a normal endless cable with two cleaning springs.

Each tube 1 contains a cleaning spring 26, 30. In most of the tubes the cleaning spring 26 is mounted as shown in FIG. 5. This means that the springs 26 belonging to two opposite tubes 1*a*, 1*b*, see also FIG. 4, are connected to each other by means of two cables 27, 28 extending over the cable drums 13, 14 to form an endless loop. The cable drums 13, 14 contain one groove 29 for each loop 26, 27, 28. The groove 29 is situated to be aligned with the corresponding pair of tubes 1*a*, 1*b*.

Figure 6:
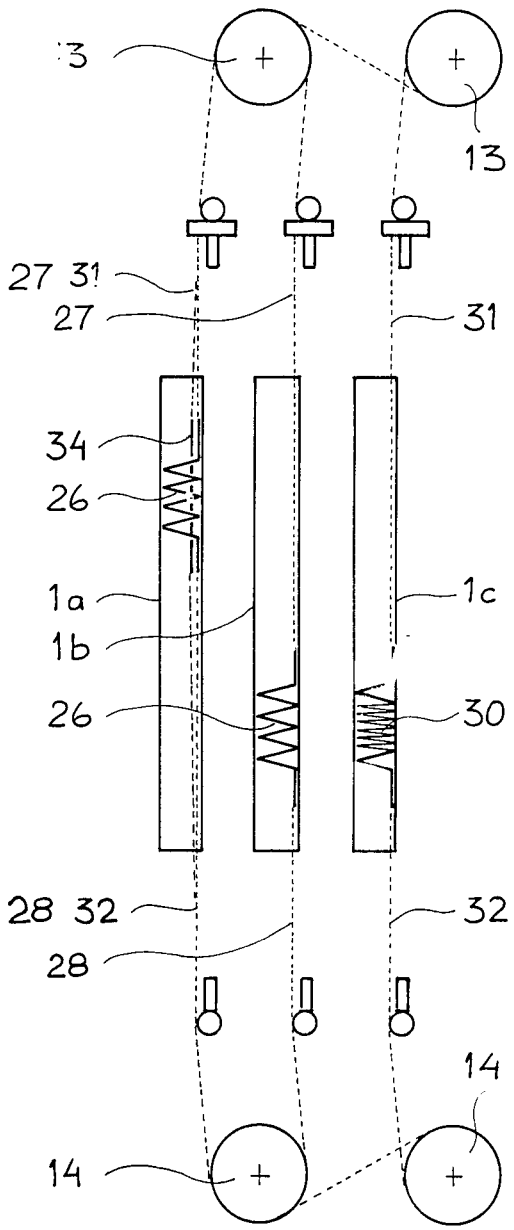
FIG. 6 illustrates an endless cable having no aligning tube.

If a tube 1*c*, FIG. 4, does not have an opposite tube its cleaning spring 30 is mounted as disclosed in FIG. 6. The two cables 31, 32 belonging to said spring 30 are wound on the cable drums 13, 14, extend via a groove 33 in the adjacent cable drum into a tube 1*a*, in which they are interconnected, by a coupling member 34, to form an endless loop. The tube 1*a* also contains a cleaning spring 26 being part of a normal endless loop 26, 27, 28.

Figure 7:
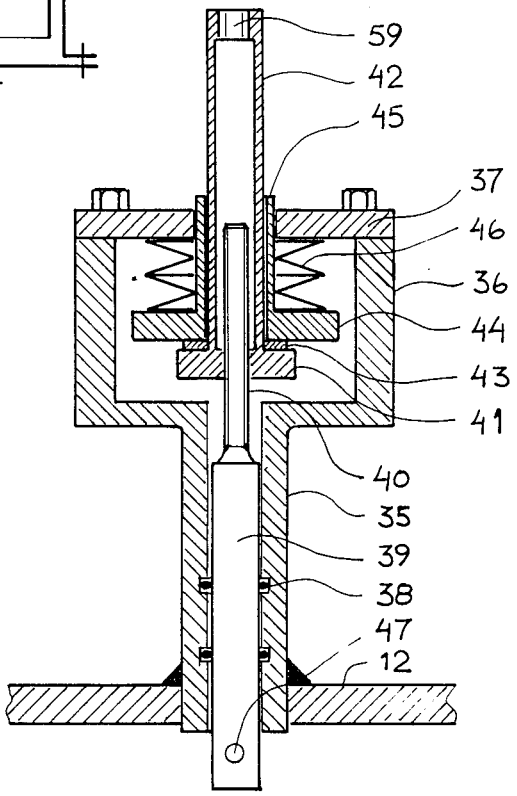
FIG. 7 illustrates a cross-section of a member for tightening the cables.

The member 17 for tightening the cables contains, as disclosed in FIG. 7, a cylinder 35, fastened to a housing 36 for springs. The housing has a cover 37. The cylinder 35 extends through the wall of the lower housing 12, and is fastened to said wall. Two piston rings 38 are arranged in grooves in the wall of the cylinder. The cylinder contains a piston 39 having a threaded upper portion 40 extending through the housing 36. The threaded portion 40 supports an adjusting nut 41, fastened to a tube 42 extending through the cover 37. The top of the tube 42 is provided with an opening 59. A flat Teflon bearing 43 is placed on the adjusting nut 41. The bearing 43 supports a disc 44 fastened to a tube 45 which surrounds the tube 42 and extends through the cover 37. A stack of cup springs 46 are arranged on the disc 44, surrounding the tube 45. An opening 47 extends diametrically through the lower portion of the piston 39. Said piston 39 is connected to the movable frame 16 in the lower housing 12 by means of a split-pin, not shown, extending through said opening 47 and a corresponding opening in the frame 16.

An electronic load relay, not shown, is connected to the electric cable of the motor 20, in series with the motor, which is an alternating current motor. Components, not shown, for the automatic operation are connected to said relay.

The cleaning spring 26 has the double task of cleaning the tube wall 1 and compensating for inaccuracies of the components actuating the tension of the cables 27, 28. It is difficult and expensive to manufacture, in mass production, a cylindrical helical spring having the accurate size required for use in the cleaning of tubes. The slightest oversize or undersize of the diameter results in a tendency of the spring to be jammed in the tube, or to loose its cleaning effect, respectively. It is an additional inconvenience of this type of spring that its diameter is reduced when its length is increased by traction. It is possible to make a spring from a comparatively thin wire, and to make its diameter oversize, resulting in a resilient contact between the spring and the tube wall. However, pulling this spring through the tube easily results in an overload and in a permanent deformation of the spring. The cleaning spring 26 of the invention has been designed otherwise, resulting in several advantages.

Figure 8:
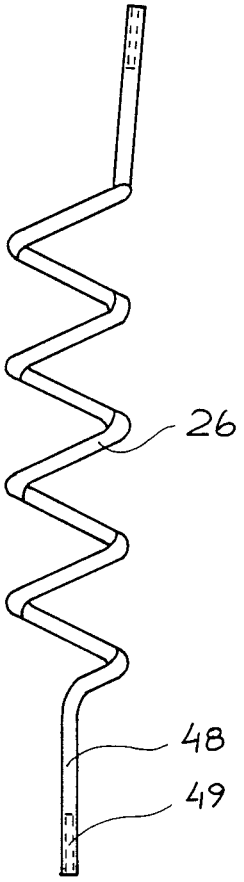
FIG. 8 illustrates a normal cleaning spring.
Figure 9:
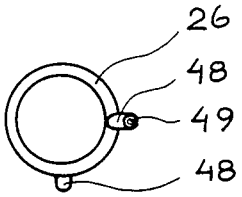
FIG. 9 is a top view of the spring of FIG. 8.

The cleaning spring 26 of FIGS. 8 and 9 is a cylindrical helical spring. It contains $4\frac{1}{4}$ turns of a round steel wire having a diameter of 2.5 mm. It has an extremely high pitch, for example 20 mm, and has an outer diameter which is a few tenths of a millimeter smaller than the inner diameter of the tube 1. The spring has shafts 48 extending from the periphery of the spring with a great radius of curvature, for example 8 mm. The shafts are bent into a substantially axial direction, and are also bent a little outward in the radial direction. Axial holes 49 are bored at the extreme ends of the shafts. The two cables 27, 28 are inserted into said holes, and are fastened to the spring by brazing.

Figure 10:
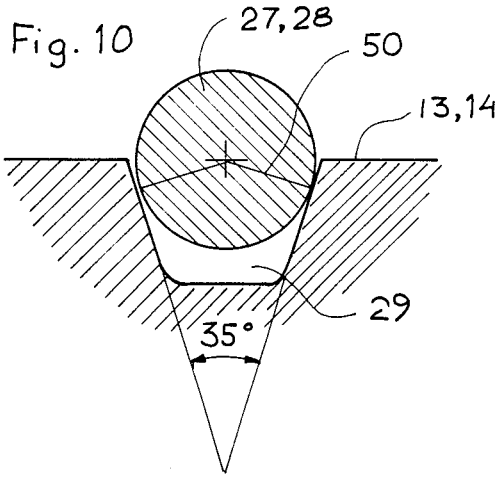
FIG. 10 is a section of a cable drum having a V-shaped groove containing a cable.

The cleaning springs 26 are pulled forward and back through the tubes 1*a*, 1*b* by the cable loop 27, 28, which is driven by the upper cable drum 13. The cable is placed in a V-shaped groove 29 in the cable drum, vide FIG. 10. The groove 29 has an apex angle of 35°. The cable does not touch the bottom of the groove, but is situated at such a depth in the groove that a cross-section of the cable has normals 50 to the walls of the groove. The loop 26, 27, 28 is kept tight by means of the tightening members 17. The cable 27, 28 is a multi-wire regular lay steel cable having a diameter of 1.5 mm. By having the shape of an endless loop the cable is secured against rotation and uncontrolled elongation when being loaded. The tension in the cable is regulated so that the force resulting from the friction in the V-groove 29 cannot exceed the permitted tension in the spring 26 without sliding of the cable 27, 28 in the groove 29. Whether the medium flowing through the tubes 1 has lubricating properties or not is a circumstance which affects the force resulting from the friction in the V-groove very little. The lower cable drum 14 is not driven, but is provided with V-grooves 29 corresponding to those of the upper cable drum 13. The majority of loops 27, 28 impart to the lower cable drum 14 a driving effect on single loops having a lower tension, thus eliminating the tendency of skidding of said single loops.

Figure 11:
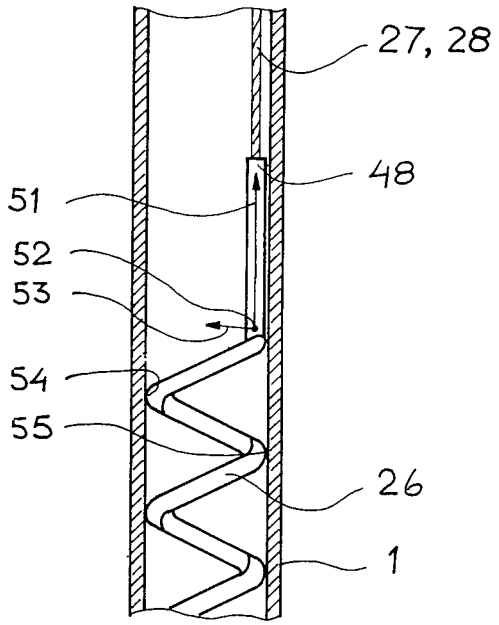
FIG. 11 illustrates a normal cleaning spring, placed inside a tube.

The cleaning effect of the spring 26 in the loop 26, 27, 28 is, as illustrated in FIG. 11, produced by the fact that the pulling force 51 at both ends of the spring 26 acts in a point 52 which is eccentrically positioned on the end surface of the cylinder defined by the spring 26. In a normal spring said pulling force acts in the center of the spring. The pulling force 51 had a direction practically parallel with the center line of the spring. This circumstance results, for all practical purposes, in a parallelogram of forces containing one component 53 extending from said point 52 transverse to the spring. This component 53 gives to the first turn of the spring two points of contact 54, 55 with the tube wall, the first point 54 at half a turn, the second point 55 at a full turn. This first turn of the spring acts as a lever having two arms and having its fulcrum in the point of contact 54. The balancing forces are the component 53 at the beginning of the turn, and the counterforce from the tube wall in the point of contact 55 at the end of the full turn. Additional points of contact may be created at the intermediate turns of the spring, as repetitions of the first mentioned points of contact. In order to distribute the four points of contact 54, 55 evenly round the tube wall, the final turn of the spring 26 only comprises $\frac{1}{4}$ of a full turn, resulting in the shafts 48 being dislocated 90° from each other. Consequently, the cleaning spring obtains the double cleaning surface and the double cleaning effect. The higher the tension is in the loop 26, 27, 28, the smaller is the diameter of the spring 26, and the higher is the pressure of the spring against the tube wall in the points of contact 54, 55, and, consequently, the better is the cleaning effect. The increased tension in the loop 26, 27, 28 also increases the wedging effect of the V-groove 29 on the cable, and consequently also the friction.

The flow velocity in the tubes is high, approximately $1\frac{1}{2}$ meter per second. The velocity is highest in the center of the tube, and, theoretically, approaches zero in the layer close to the tube wall. Therefore, the design of the cleaning spring 26 as a cylindrical helical spring having shafts 48 extending peripherally, and being fastened to the cables without creating any loss of pressure, results in a cleaning member producing a minimal loss of pressure, and leaving the central opening of the spring free, to allow the passage of solid impurities accompanying the flowing medium. The shafts 48 are prestressed by having been bent outwardly, as mentioned above, with the result that said shafts 48 and the cable 27, 28 stay close to the tube wall 1 even when tension is applied to the loop 26, 27, 28 and the component 51 in the parallelogram of forces referred to above tends to bend the shafts 48 inwardly. This prestressing has the additional effect that the cleaning springs 26 in a loop 26, 27, 28 having a lower tension exert a basic cleaning effect.

The wire of the cleaning spring may have any cross-sectional shape. We prefer a round wire, i.e. a wire having a circular cross-section, because it results in several advantages. A round wire has a small surface of contact with the tube wall 1, and a large surface of contact with the medium flowing in the tube. Therefore, the wire will have the same temperature as the medium, thus eliminating the danger of a precipitate covering the wire. The initial wear of the four points of contact 54,55 against the tube wall will rapidly result in wider surfaces of contact extending round the entire spring. The required wear is very small, because the difference in diameter between the spring 26 and the tube 1 is small, and because the chord of the wire profile on which the wear takes place is short. The continued wear decreases as the length of the chord increases. The wear affects the characteristics of the cleaning spring 26 only little, because the stresses determining said characteristics are concentrated to the inner side of the spring wire. The round wire profile, the large radius of curvature of the bent portion of the shafts, and the large pitch of the spring facilitate very much the insertion of the cleaning spring 26 into the tube 1.

Between cleaning operations the cleaning springs are positioned outside the tubes 1, haft the number of springs at each end of the heat exchanger. Placing the springs inside the tubes 1 would involve the danger of galvanic corrosion, and would create an increased loss of pressure. Placing the springs outside the tubes 1 facilitates the cleaning of the springs by the flowing medium being able to flush freely around the springs 26. Placing half the number of the springs at each end of the heat exchanger also produces an additional advantage in certain heat exchangers, e.g. evaporators, in which a coating preferably precipitates in the evaporating portion of the tube 1. One cleaning spring 26 of each loop 26,27,28 will be pulled through a clean portion of a tube 1, while the other spring of said loop is being pulled through a coated portion of a tube. Halfway through the tubes the function of the springs will be reversed, resulting in a more even load of the motor, and in a better functioning of the automatic system.

Theoretically, all the 355 cleaning springs shall accompany each other, half in each direction. For various reasons a loop 27,28 may slide, the cleaning springs 26 of said loop coming behind the other springs, with the risk of being positioned inside the tube 1. When moving in the reverse direction said springs will be ahead of the other springs, with the risk of being pulled past the cable guides 23 to the cable drums 13, 14 where they would be destroyed. The T-shaped rods 25 in the upper housing 11 act, however, as stop rods. The cleaning spring 26 which is ahead of the other springs is stopped when it reaches the slot 58 of the stop rod 25. The cables 27,28 of said cleaning spring now skid in the groove 29 until the majority of the cleaning springs 26 have reached the slots 58. The braking force produced by said majority of springs gives an impulse to the electronic load relay mentioned above to stop the motor 20.

The stop rod 25 defines exactly the inactive position of the cleaning springs 26. Therefore, it has been possible to locate said inactive position close to the place where an obstacle in the medium flow starts creating a measurable loss of pressure. This location of the inactive position makes it possible to build the two housings 11, 12 with a low height. Therefore, in the illustrated embodiment the housings 11,12 are contained within the normal height of the two conical head chambers referred to above.

Figure 13:
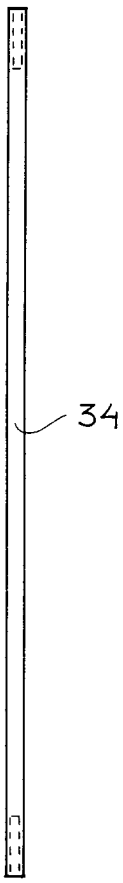
FIG. 13 illustrates a connecting member.

As illustrated in FIG. 4, 10% of the tubes 1 have no opposite tube required for creating a normal loop 26,27,28. The problem has been solved in the way illustrated by FIG. 6 as a result of the operation by means of cog wheels 18, i.e. as a result of the direct engagement between cog wheels 18 which are exactly alike, and as a result of adjacent cable drums 13 having opposite directions of rotation and the same velocity of rotation. The groove 33 pulls the cable, whereas the groove 29 for the single tube 1*c* does not pull the cable. The connecting member 34 is positioned close to the inner side of the cleaning spring 26 in the tube 1*a*. Said connecting member 34, FIG. 13, consists of a straight piece of wire of the same diameter and material as the wire constituting the cleaning spring 26, and of the same length as the spring 26. The connecting member 34 is fastened to the cables 31, 32 in the same way as the cleaning spring 30.

Figure 12:
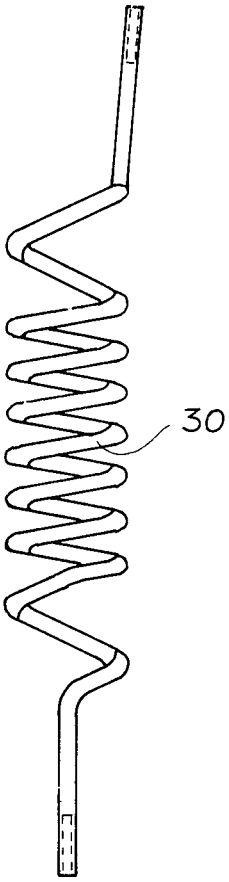
FIG. 12 illustrates a cleaning spring containing the double number of turns.

The single cleaning spring 30, FIG. 12, is wound to form $8\frac{1}{4}$ turns, so that its resilience shall be approximately equal to that of two normal cleaning springs 26. The space required for the extra turns of the spring 30 has been created by a reduced pitch for all turns except the extreme turns. In other respects, all facts given for the normal spring 26 are true also for the spring 30.

It is the object of the four tightening members 17 to move the frame 16, supporting the cable drums 14, downward, thus tightening the loops 26,27,28 to such an extent that the V-grooves 29 in the cable drums 13 of the upper housing 11 pull the cable. This is done by inserting an tool into the opening 59 of the tube 49, and rotating the adjusting nut 41 so as to move upward on the threaded portion 40, thus moving the piston 39 downward. Simultaneously, the cup springs 46 are compressed between the nut 44 and the cover 37 to an extent proportional to the tension of the cables. Simultaneously, the tube 45 is being moved upward above the cover 37 by a distance corresponding to the compression of the stack of cup springs 46. Said distance represents the pressure of the piston 39 on the frame 16. The distance can readily be measured by means of a caliper rule, and the pressure is found by means of a table of calibration. The accuracy of the tightening member is 10 kilopond more or less than the pressure obtained from the calibration. Therefore, the number, position and accuracy of the tightening members 17 permit a very even distribution of the tension in the loops 26, 27,28. The external operation of the tightening members 17 makes it possible to remove any brittle deposited coating on the cleaning springs 26, viz. by alternatingly tightening and releasing the loops 26,27, 28, resulting in the brittle coating being cracked and scaled off.

The motor 20, with its cog wheel gearbox, which drives the cable drums 13, has a very low gear. Its output axle rotates with approximately 6 r.p.m., imparting to the cleaning springs 26 a velocity of approximately 20 mm per second. the coupling 21 is a high elasticity coupling, permitting 20° angular movement between the two halves upon a maximal temporary load. The driving axle 22 is coupled to one of the two intermediate cable drums 13, thus minimizing the number of cog wheels 18 connected in series, and the pressure between the cogs.

When the cleaning springs 26 have reached the stop rods 25, the load on the motor 20 rapidly increases. An impulse to stop the motor 20 is now created by an electronic load relay as disclosed in the Swedish Pat. No. 8000672-9. The relay first measures the power fed to the motor 20, and subsequently subtracts an amount which is proportional to the current to the motor and to the internal loss of power. The compensation for the internal loss can be regulated. The relay consists of a load detector and a load converter. The load detector is adjustable for the highest permitted load. It is provided with an output relay contact which stops the motor when the predetermined load limit has been exceeded. The reaction time of the load detector is 0.1 second. As a consequence, an electric contact governing the direction of rotation of the motor is automatically switched over, and an adjustable time relay is started. When the predetermined time has lapsed, the time relay will start the motor. An impulse counter indicates the total number of cleaning operations. The load limit is set so that a small number of cleaning springs 26 are allowed to reach the stop rods 25, their cables 27,28 sliding in the grooves 29, without the load limit being exceeded.

When a larger number of springs 26 have reached the stops rods 25, and the predetermined load limit has been exceeded, the motor 20 will be stopped within the reaction time mentioned above. During this time the periphery of the cable drums will rotate approximately 2 mm, but the cables 27 will not slide in their grooves because of the soft braking of the springs 26 produced by the elastic coupling 21, and because of the short reaction time. The load converter is adjustable for an output signal which is proportional to the load of the motor 20. The output signal is conveyed to an indicating instrument and to a recorder.

The cleaning device is not accessible for inspection during operation. The indicating and recording members of the automatic system, the indicating tubes 45 of the tightening members 17, and the known members of the heat exchanger for measuring the steam flow and the pressure differences, make it possible to draw conclusions on what adjustments have to be made from the outside of the device. Such adjustments may be changing the frequency of the cleaning operations, changing the tension of the cables to avoid sliding or to compensate for the wear of the cleaning springs or to increase the pressure of the springs against the tube wall 1.

The parts which are mainly consumed during operation are the cables 27,28 and the cleaning springs 26. They last for approximately 50,000 cleaning operations, for example one cleaning operation every 10 minutes for one year.

OTHER EMBODIMENTS

Within the scope of the claims, the good results being maintained, the cleaning device may be varied in several realistic ways, as described below.

Figure 14:
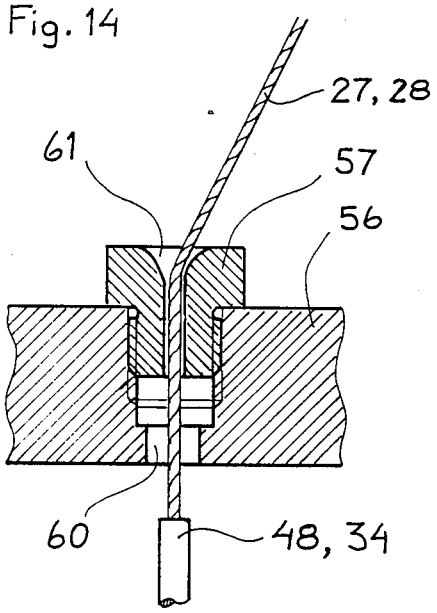
FIG. 14 illustrates a cable guide.

In a heat exchanger having a large diameter, the bearings of the cable drums may be situated within the periphery of the cluster of tubes 1. In a heat exchanger having the tubes arranged in a complicated pattern, the cable drums may be placed in several levels. If the heat exchanger is designed with partitions in the head chambers, producing a repeated flow of the medium through the tubes, the cable drums 13, 14 may extend through said partitions. Alternatively, a separate housing for the cable drums may be placed on top of the head chamber, and the cables 27,28, FIG. 14, may extend through openings 60 in the wall 56 separating the cable drum housing from the head chamber. The openings 60 are too small for the passage of the cleaning springs. A bushing 57 is fastened by screw threads in each opening 60. Said bushing has a substantially conical opening 61 having a rounded surface so that the cable can slide on the bushing without wear. This structure has double functions, viz. that of the cable guide 23 and that of the stop rods 25. In addition, the opening 60,61 may guide the cable 27, 28 individually in all directions, whereas the round rod 23 can only guide the cables collectively and in one direction. This individual guiding of the cables makes it possible to guide the cables 27,28 also to a cluster of tubes situated in an asymmetric pattern relative to the positions of the cable drums 13, 14. The method of guiding the cables by means of openings can be used also in the main embodiment described above. In this case the members 23,24,25,58 are replaced by horizontally situated rods in which the screws 57 have been fixed.

The V-shaped grooves 29 of the cable drums 13,14 may have a larger or smaller apex angle than 35°, depending on to what extent the grooves are desired to pull the cables. The V-shaped grooves 29 may be replaced by grooves which do not pull the cables, for example grooves having a flat bottom and being wider than the diameter of the cable. The cable may extend around the drum 13,14 more than the usual half turn. The V-grooves 29 may be replaced by a shallow grooved surface having a pattern fitting that of the wires of the cable.

The upper and the lower housings 11,12 with their components may change places. The housings 11,12 may have different shapes, for example a cylindrical shape. The shape may be such that the medium flows at an angle through the housing. The cog wheels 18 may be situated on the very drums, i.e. between the bearings 15.

The tightening members 17 may be arranged to pull instead of push, or they may be arranged to pull and push. The number of tightening members may be higher or lower than four. If the medium flows at an angle through the housing, the tightening members may be situated in the cover at the extreme end of the heat exchanger. The tightening members may be screwed to the wall of the housing 12. Their adjusting and resilient components 40–46 may be replaced by a piston or a membrane actuated by the medium. In this case the tightening member 17 may have an internal position, and the movable piston 39 may be replaced by a stationary pipe.

The cog wheel motor 20 may be replaced by a motor which is positioned internally and is driven by the medium. In this case the movable axle 22 is replaced by a stationary pipe. The members 18,20,21,22 driving the cable drums 13,14 may be divided into sections, each section having a driving motor. The members 18 connected in series to drive the cable drums 13,14 may be replaced by a common axle and worm gears. The frictional driving grooves 29 in the cable drums 14 of the lower housing 12 may be replaced by a synchronous transmission from the driving member 20 for the cable drums of the upper housing 11.

The cleaning spring 26 may contain a higher or lower number of turns than the illustrated embodiment, which has $4\frac{1}{4}$ turns, preferably $1\frac{1}{4}$–7 turns. The angular displacement of the shafts 48 may be different from 90°. In tubes having a large diameter, said angular displacement may be 0° or 180°, because the difference between the diameters of the tube 1 and the cleaning spring 26 is proportionally smaller, and the size of the areas of contact 54,55 is proportionally larger. The eccentric position of the point 52, in which the pulling force 51 acts upon the end surface of the cylindrical spring 26, may be varied from the periphery to a point nearer the center. The position depends, i.a., upon the desired pressure of the spring 26 on the tube wall relative to the tension of the cable and the permitted maximal load on the spring. The direction of the shaft 48 from the cleaning spring 26 to the cable 27,28 may be varied. For example, the shaft 48 may extend in a radial direction relative to the cylindrical spring 26, and may have a radial opening for the cable 27,28 in the point 52 where the pulling force 51 acts upon the spring. The cable 27,28 may be fastened directly to the wire constituting the cylindrical portion 26 of the spring, by means of a similar radial opening in said wire. If the tubes 1 consist of a tender material, such as graphite, a scraping contact between the spring and the tube wall is not desired. In this case, the point 52, in which the pulling force 51 acts upon the spring, may be positioned centrally on the end surface of the cylindrical spring 26. Said central position makes it possible to adjust exactly the depth of cleaning, without scraping, viz. by the combination consisting of the external adjustment of the tightening members 17, the accuracy of said adjustment, the load converter of the automatic system, and the reduction of the diameter of the spring when being elongated. The turns of the spring 26 at its extreme ends may have a somewhat conical shape, thus making it still more easy to insert the cleaning spring 26 into the tube 1. The spring 26 may be wound with a right-hand or left-hand pitch. The wire of the cleaning spring 26 may consist of another suitable material, such as stainless steel, a non-ferrous metal, titanium, or a composite material of plastic and fibers. The wire may have a square cross-sectional shape. Its surface may be treated to reduce the adhesion of the scraped-off coating, for exemple electro-polished or Teflon-coated.

Under difficult cleaning conditions it may be to advantage that the cable loop 27,28 contains only one cleaning spring 26, instead of two. One of the two springs has been replaced by a coupling member 34, and the cable drums 13,14 contain the double number of grooves 29. Instead of being joined to the spring 26 and to the coupling member 34 by brazing, it may be hooked or screwed or pressed fast to said spring and said member.

The cable 27,28 may consist of another material, such as stainless steel, a non-ferrous metal, titanium, or a composite of plastic and fibers. The cable may be wound in another pattern. One of the cables 27,28 may be wound with a right-hand pitch, the other with a left-hand pitch, to counteract the rotation of the cable.

The load detector may be supplemented with a known time-meter or position-meter designed to stop the motor 20 just before it would have been stopped by the load detector. This device reduces the wear of the cables 27 and the coupling 21 occurring when the cleaning springs 26 are stopped by the stop rod 25. A programmer shifts the device between said two stopping methods, so that, say, five cleaning operations with an early stop before the stop rod 25 are followed by a cleaning operation with an ordinary stop by means of the stop rod 25. Another method to the same effect is to use a two-speed cog-wheel gear motor 20. The impulse for changing the speed of the motor is received either from the load converter, viz. when the signal from said load converter becomes weaker as a result of the springs 26 leaving the tubes 1, or from the time-meter or the position-meter. The last-named method permits a higher speed of the cleaning springs in the tubes. Finally, the load detector may in a known way base its determination of the load upon one or more other electrical characteristics of the motor 20, than those mentioned in the Swedish patent referred to above, e.g. the current or the power of the motor, or the phase difference between the voltage and the current of the motor.

I claim:

1. A device for internal cleaning during operation, of the tubes of a heat exchanger containing a plurality of substantially straight tubes having both ends fastened to tube sheets; and head chambers outside the tube sheets for the medium flowing through the tubes comprising cleaning members in each of the tubes, driving means comprising cable drums, cables in contact with said drums to pull the cleaning members through the tubes, each end of each cleaning member being attached to a cable end; and wherein each of the cleaning members comprises a substantially cylindrical helical spring having an axis extending along a tube axis, the spring being open centrally to permit straight and free flow of said medium, the spring having an external diameter which, in the unloaded condition of the spring, is slightly smaller than the internal diameter of the tube in which the spring is located, and the cable attachment point to at least one of the spring ends is located offset from the spring axis.

2. A device according to claim 1, wherein both the cable attachment points to the spring ends are located offset from the spring axis.

3. A device according to claim 1 wherein each spring comprises a whole number of turns plus a fraction of a turn, as measured from the points in which a cable end is attached to each spring.

4. A device according to claim 2 wherein each spring comprises a whole number of turns plus a fraction of a turn, as measured from the points in which a cable end is attached to each spring.

5. A device according to claim 3 wherein said fraction is about $\frac{1}{4}$ of a turn.

6. A device according to claim 4 wherein said fraction is about $\frac{1}{4}$ of a turn.

7. A device according to claim 3 wherein straight end portions extend from said fraction of a turn, said end portions lying in axial planes of the spring and being directed away from the spring coil.

8. A device according to claim 5 wherein straight end portions extend from said fraction of a turn, said end portions lying in axial planes of the spring and being directed away from the spring coil.

9. A device according to claim 7 wherein the straight end portions slightly diverge from the spring axis, in direction away from the spring coil.

10. A device according to claim 8 wherein the straight end portions slightly diverge from the spring axis, in direction away from the spring coil.

11. A device according to claim 7 wherein the ends of the spring have axial blind holes for receiving the cable ends.

12. A device according to claim 9 wherein the ends of the spring have axial blind holes for receiving the cable ends.

13. A device according to claim 1 wherein means for tightening the cables are provided to maintain the spring tensioned so as to engage the tube wall.

14. A device according to claim 2 wherein means for tightening the cables are provided to maintain the spring tensioned so as to engage the tube wall.

15. A device according to claim 3 wherein means for tightening the cables are provided to maintain the spring tensioned so as to engage the tube wall.

16. A device according to claim 3 characterized in that said fraction is about $\frac{3}{4}$ of a turn.

* * * * *